US005322011A

United States Patent [19]

Hahne et al.

[11] Patent Number: 5,322,011

[45] Date of Patent: Jun. 21, 1994

[54] PRESSURE CYLINDER WITH ELECTROSTATICALLY ASSISTED INK TRANSFER

[75] Inventors: Ernst A. Hahne; Franz Knopf, both of Allschwil, Switzerland

[73] Assignee: Eltex-Elektrostatik GmbH, Weil am Rhein, Fed. Rep. of Germany

[21] Appl. No.: 18,885

[22] Filed: Feb. 17, 1993

[30] Foreign Application Priority Data

Feb. 18, 1992 [DE] Fed. Rep. of Germany ..... 4204871

[51] Int. Cl.[5] ..... B41F 9/00

[52] U.S. Cl. ..... 101/153; 101/375

[58] Field of Search ..... 101/375, 401.1, 153, 101/219, 170; 29/110, 132

[56] References Cited

U.S. PATENT DOCUMENTS

| | | | |
|---|---|---|---|
| 2,558,900 | 7/1951 | Hooper | 101/219 |
| 2,558,901 | 7/1951 | Hooper | 101/493 |
| 3,477,369 | 11/1969 | Adamson et al. | 101/153 |
| 3,489,082 | 1/1970 | Morris | 101/153 |
| 3,625,146 | 7/1971 | Hutchison | 101/153 |
| 4,099,462 | 7/1978 | Coberley et al. | 101/153 |
| 4,364,313 | 12/1982 | Hyllberg | 101/375 |
| 4,372,205 | 2/1983 | Pflaum | 101/153 |
| 4,539,908 | 9/1985 | Spengler | 101/153 |
| 4,909,147 | 3/1990 | George et al. | 101/153 |
| 4,966,555 | 10/1990 | Zagorski | 101/153 |
| 5,044,275 | 9/1991 | Knopf et al. | 101/153 |

*Primary Examiner*—Eugene H. Eickholt
*Attorney, Agent, or Firm*—Max Fogiel

[57] ABSTRACT

A pressure cylinder is accommodated in a printing assembly and provided with electrostatically assisted ink transfer. Its shaft is mounted in the framework of a printing press. It has a semiconductive jacket that is mounted over a steel surface and can be electrically charged. The shaft is electrically connected to the surface of the cylinder and electrically insulated from the framework. An electric potential can be applied to the shaft in order to charge the semiconductive jacket.

3 Claims, 2 Drawing Sheets

PRESSURE CYLINDER WITH ELECTROSTATICALLY ASSISTED INK TRANSFER

BACKGROUND OF THE INVENTION

The invention concerns a pressure cylinder accommodated in a printing assembly and provided with electrostatically assisted ink transfer.

Many printing aids of this type are known. They produce an electric field in the nip between the pressure cylinder and a plate cylinder. The field promotes the transfer of ink from the ink cylinder to the substrate, which is usually a web of paper. A charge is simultaneously applied to the surface of the pressure cylinder from outside, specifically to the semiconducting jacket.

These known embodiments have a drawback in that each pressure cylinder must be adapted to the technical requirements of each type of press. This necessitates considerable engineering.

SUMMARY OF THE INVENTION

The object of the present invention is accordingly to improve a pressure cylinder of the aforesaid type to the extent that it will be as simple and universally applicable as possible.

Current is accordingly introduced in accordance with the invention through the pressure cylinder's shaft. From the shaft the current travels radially out into the semiconductive jacket. No space will be occupied by the conventional apparatus for applying charge to the pressure cylinder from outside. The semiconductive jacket can be mounted directly over the metal base of the pressure cylinder. The major advantage, however, is the simplicity involved in transmitting charge from a direct-current generator to the cylinder's surface through its shaft. The metal cylinder base assumes responsibility for the low-resistance distribution of the applied potential. Another special advantage is that the pressure cylinder can be employed in explosion-hazard areas.

The subsidiary claims recite practical embodiments and advanced versions of the invention.

BRIEF DESCRIPTION OF THE DRAWINGS

Two preferred embodiments of the invention will now be specified with reference to the drawing, wherein.

DESCRIPTION OF THE PREFERRED EMBODIMENTS

Figure 1:
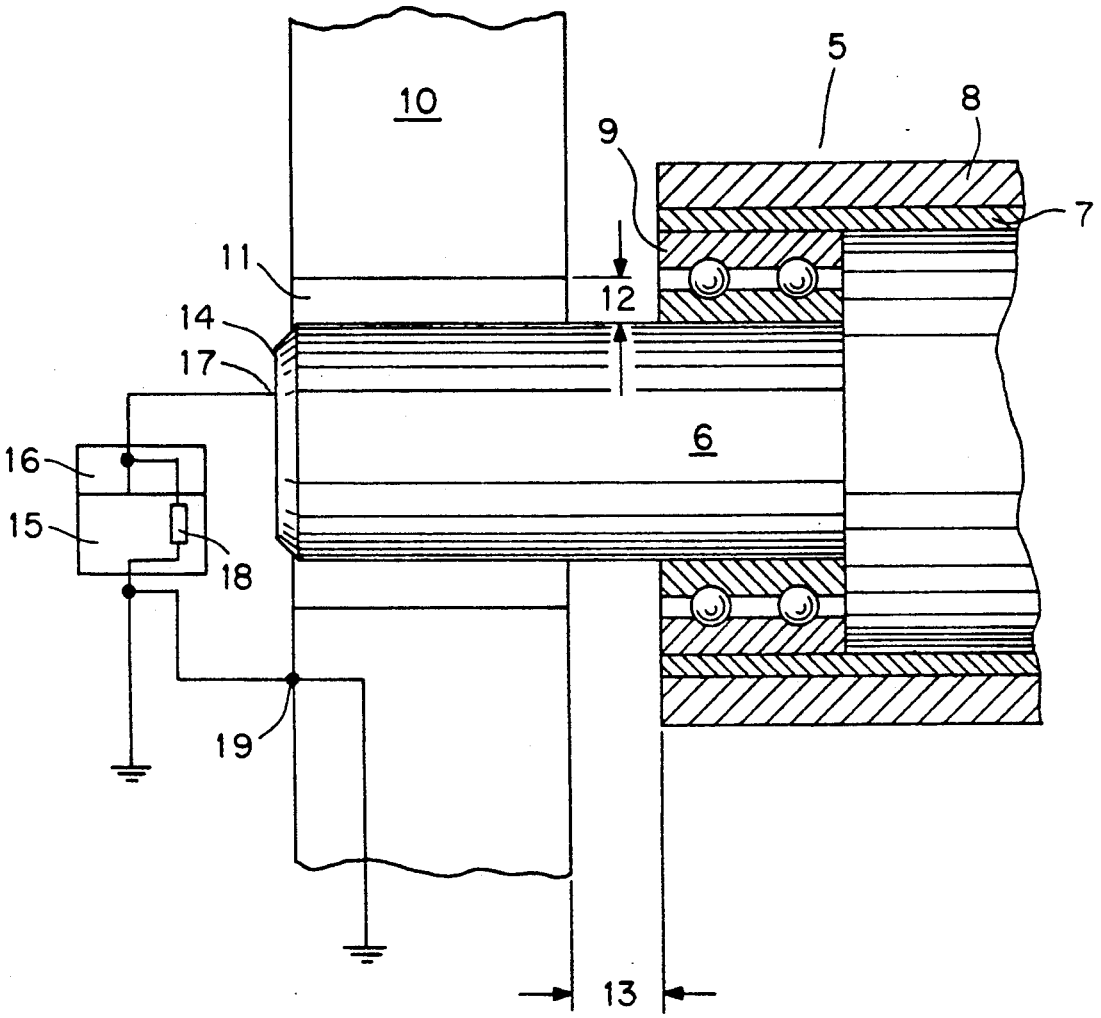
FIG. 1 is a schematic truncated cross-section of part of one embodiment of the invention and FIG. 2 is a schematic truncated cross-section of part of another embodiment.

A pressure cylinder 5 is provided with electrostatically assisted ink transfer. The cylinder has a stationary shaft 6 and a steel surface 7. A semiconductive jacket 8 is mounted over surface 7. Semiconductive jacket 8 can be electrically charged. Between shaft 6 and surface 7 is a ball bearing 9.

Shaft 6 is inserted in electric insulation 11 in the framework 10 of a printing press at intervals 12 and 13 sufficient to prevent discharge and sparkover.

The end 14 of shaft 6 is connected to a generator 15 and sensor 16 by a connector 17. The line to connector 17 is grounded at a resistor 18. Resistor 18 constitutes in conjunction with the cylinder's capacity the cylinder's discharge-time constant. Framework 1 is also grounded, as schematically illustrated at point 19.

Figure 2:
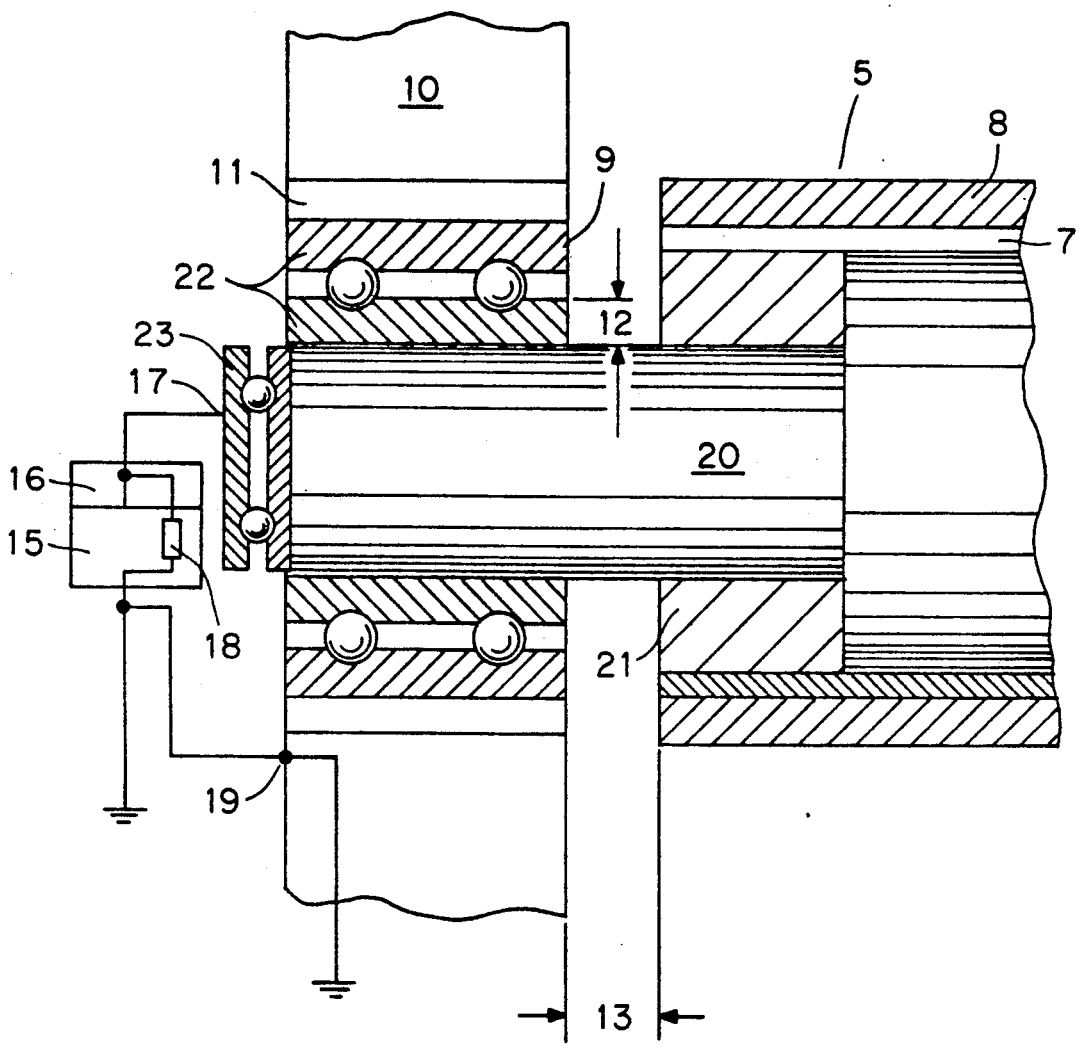

The embodiment illustrated in FIG. 2 differs from that illustrated in FIG. 1 by a shaft 20 instead of shaft 6. Shaft 20 is rigidly fastened to steel cylinder surface 7 by an electrically conductive intermediate 21.

Shaft 20 is accordingly mounted in framework 10 by way of an electrically insulating ball bearing 22 or of separate insulation 11. It is also possible to use a conventional electrically conducting ball bearing with an insulating bushing between it and the framework.

A thrust bearing 23 can be mounted against the end 14 of shaft 20. Thrust bearing 23 is electrically conductive, and the connector 17 to generator 15 is mounted on it by way of sensor 16.

Either of the aforesaid embodiments ensures that potential applied to shaft 6 or 20 will be prevented by insulation 11 from entering framework 10 and that high voltage can enter the semiconductive jacket 8 around pressure cylinder 5 from inside.

We claim:

1. A pressure cylinder in a printing assembly and provided with electrostatically assisted ink transfer, comprising: a printing press with a framework; a shaft mounted in said framework; a semi-conductive jacket spaced from said shaft and mounted over a steel surface and electrically charged, said pressure cylinder having a cylinder surface, said shaft being electrically connected to said cylinder surface and being electrically insulated from said framework and means for applying an electrical potential to said shaft for charging said semi-conductive jacket; a thrust bearing at an end of said shaft, said electrical potential being applied through said thrust bearing.

2. A pressure cylinder in a printing assembly and provided with electrostatically assisted ink transfer, comprising: a printing press with a framework; a shaft mounted in said framework; a semi-conductive jacket spaced from said shaft and mounted over a steel surface and electrically charged, said pressure cylinder having a cylinder surface, said shaft being electrically connected to said cylinder surface and being electrically insulated from said framework; and means for applying an electrical potential to said shaft for charging said semi-conductive jacket; said steel surface being mounted on said shaft; a ball bearing between said shaft and said steel surface; electrical insulation means between said shaft and said framework and spaced from said ball bearing and said steel surface to prevent electrical discharge and spark over; said means for applying an electrical potential comprises a generator and sensor connected to the end of said shaft through connector means at ground potential, said framework being also at ground potential.

3. A pressure cylinder in a printing assembly and provided with electrostatically assisted ink transfer, comprising: a printing press with a framework; a shaft mounted in said framework and having an interior and a peripheral surface; a semi-conductive jacket spaced from said shaft and mounted over a steel surface and electrically charged, said pressure cylinder having a cylinder surface, said shaft being electrically connected to said cylinder and being electrically insulated from said framework; and means for applying an electrical potential to the interior of said shaft spaced from the peripheral surface of said shaft for charging said semi-conductive jacket; said steel surface being mounted on said shaft; a ball bearing between said shaft and said steel surface; electrical insulation means between said shaft and said framework and spaced from said ball bearing and said steel surface to prevent electrical discharge and spark over.

* * * * *